US011098984B2

(12) United States Patent
Echeverria

(10) Patent No.: US 11,098,984 B2
(45) Date of Patent: Aug. 24, 2021

(54) METHOD AND A DEVICE FOR CONTROLLING AND POWERING A SMOKE GENERATOR

(71) Applicant: Verisure Sàrl, Versoix (CH)

(72) Inventor: Jon Noble Echeverria, Madrid (ES)

(73) Assignee: VERISURE SARL

( * ) Notice: Subject to any disclaimer, the term of this patent is extended or adjusted under 35 U.S.C. 154(b) by 228 days.

(21) Appl. No.: 16/347,221

(22) PCT Filed: Oct. 31, 2017

(86) PCT No.: PCT/EP2017/077901
§ 371 (c)(1),
(2) Date: May 3, 2019

(87) PCT Pub. No.: WO2018/083091
PCT Pub. Date: May 11, 2018

(65) Prior Publication Data

US 2020/0333115 A1 Oct. 22, 2020

(30) Foreign Application Priority Data

Nov. 4, 2016 (EP) ..... 16197292

(51) Int. Cl.
*G08B 15/02* (2006.01)
*F41H 9/06* (2006.01)

(52) U.S. Cl.
CPC ..... *F41H 9/06* (2013.01); *G08B 15/02* (2013.01)

(58) Field of Classification Search
CPC ..... F41H 9/06; G08B 1/00
See application file for complete search history.

(56) References Cited

U.S. PATENT DOCUMENTS 6,094,135 A * 7/2000 Sugimoto ..... G08B 15/02 340/541
2010/0025131 A1* 2/2010 Gloceri ..... B62D 21/11 180/65.28

FOREIGN PATENT DOCUMENTS

DE 60207349 8/2006
DE 60207349 T2 * 8/2006 ..... G08B 15/02
(Continued)

OTHER PUBLICATIONS

International Search Report and Written Opinion from corresponding International Patent Application No. PCT/EP2017/077901, dated Jan. 16, 2018, 15 pages.

*Primary Examiner* — Shirley Lu
(74) *Attorney, Agent, or Firm* — Tucker Ellis LLP

(57) ABSTRACT

A smoke generator and driver circuit (46) for controlling and powering a smoke generating canister (38), said driver circuit (46) comprising a power output connected to said smoke generating canister (38) for activation thereof. It comprises a charging unit (50) providing after a charging process sufficient power for igniting and driving said smoke generating canister (38), a switching unit (52) connected to said charging unit (50) and to a first pole (56) of said smoke generating canister (38) for releasing power from said charging unit (50) to said smoke generating canister (38), and a connecting unit (54) connected to a second pole (58) of said smoke generating canister (38) for allowing power to flow through said smoke generating canister (38), wherein activation of both said connecting unit (54) and said switching unit (52) during an overlapping time period is required for activation of said smoke generating canister (38). A method comprises applying a charging signal a charging input of the driver circuit (46), applying a control signal to a connect input of said driver circuit (46), and applying a trigger signal at a trigger input of switching unit (52).

11 Claims, 3 Drawing Sheets

(56) References Cited

FOREIGN PATENT DOCUMENTS

| | | | |
|---|---|---|---|
| EP | 0664532 | A1 | 7/1995 |
| EP | 2719432 | A1 | 4/2014 |
| EP | 2778599 | A1 | 9/2014 |
| GB | 2270396 | | 3/1994 |
| GB | 2324636 | | 10/1998 |

* cited by examiner

METHOD AND A DEVICE FOR CONTROLLING AND POWERING A SMOKE GENERATOR

TECHNICAL FIELD

The invention relates to a method and a device for controlling and powering a smoke generator. Generally, a smoke generator is an electrically ignited device for producing a non-toxic opaque smoke. A specific application for smoke generators is the use as an active addition to alarm systems. Such alarm systems are commonly used in domestic houses, industrial premises, commercial premises and office premises as well as other premises and buildings to detect unauthorized intrusion such as burglary, damages and similar. In alarm systems the smoke generator normally is activated in connection with activation of other alarm functions, such as sound signals and a request for assistance that is sent to a remote monitoring station.

PRIOR ART

An anti-intrusion security system in accordance with EP2778599 comprises fog-generating devices which impairs the sight of an intruder when activated. The devices for generating the fog comprise a heat exchanger for heating and vaporising the fluid with a resistor embedded on a body. When an intruder detection system is activated, an appropriate signal is sent to an anti-intrusion security system that initiates delivery of fog.

EP2719432 discloses a fog-generating device comprising a power source and a reservoir containing fog-generating liquid. An external surveillance system may send an alarm signal to the fog-generating device, upon which a switch is controlled in the fog-generating device which closes a circuit containing the ignition energy source (e.g. a capacitor or supercapacitor) and the ignition means, thereby igniting the reagent.

When the appropriate signal is sent to the smoke generator and the smoke generating process has been initiated it is not possible to interrupt or stop the process. Therefore, it is desirable to improve the safety arrangements around the initiating process, so as to reduce the risk for unintentional activation of the smoke generator.

SUMMARY OF THE INVENTION

In accordance with the invention there is provided a device for controlling and powering a smoke generator, said device comprising a power output connected to said smoke generator for activating thereof. The invention relates also to a method for controlling and powering the smoke generator. There is a special concern about the possibility of having an accidental activation of the smoke generator. Once the smoke generation is activated, the pyrotechnic nature of the product disables the possibility of stopping the smoke generation.

In various embodiments the device is a peripheral comprising a safety circuit and the smoke generator. The smoke generator comprises a smoke generator component, referred to as a canister. The device will generate smoke in the premises after a burglary or danger situation is verified, for instance from a remote monitoring station. For this purpose, the new device can be integrated in presently available alarm systems as any other peripheral, communicating with at least one control unit, also referred to as a gateway, via a radio frequency, RF, interface.

In various embodiments the device is designed to guarantee a reliable activation during the full life cycle of the device. The device in accordance with the invention will have a very quick and secure action. Emission of smoke starts within seconds of activation and will last at least one minute. The opacity of the smoke is very high.

BRIEF DESCRIPTION OF THE DRAWINGS

In order that the manner in which the above recited and other ad-vantages and objects of the invention are obtained will be readily understood, a more particular description of the invention briefly described above will be rendered by reference to specific embodiments thereof which are illustrated in the appended drawings.

Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
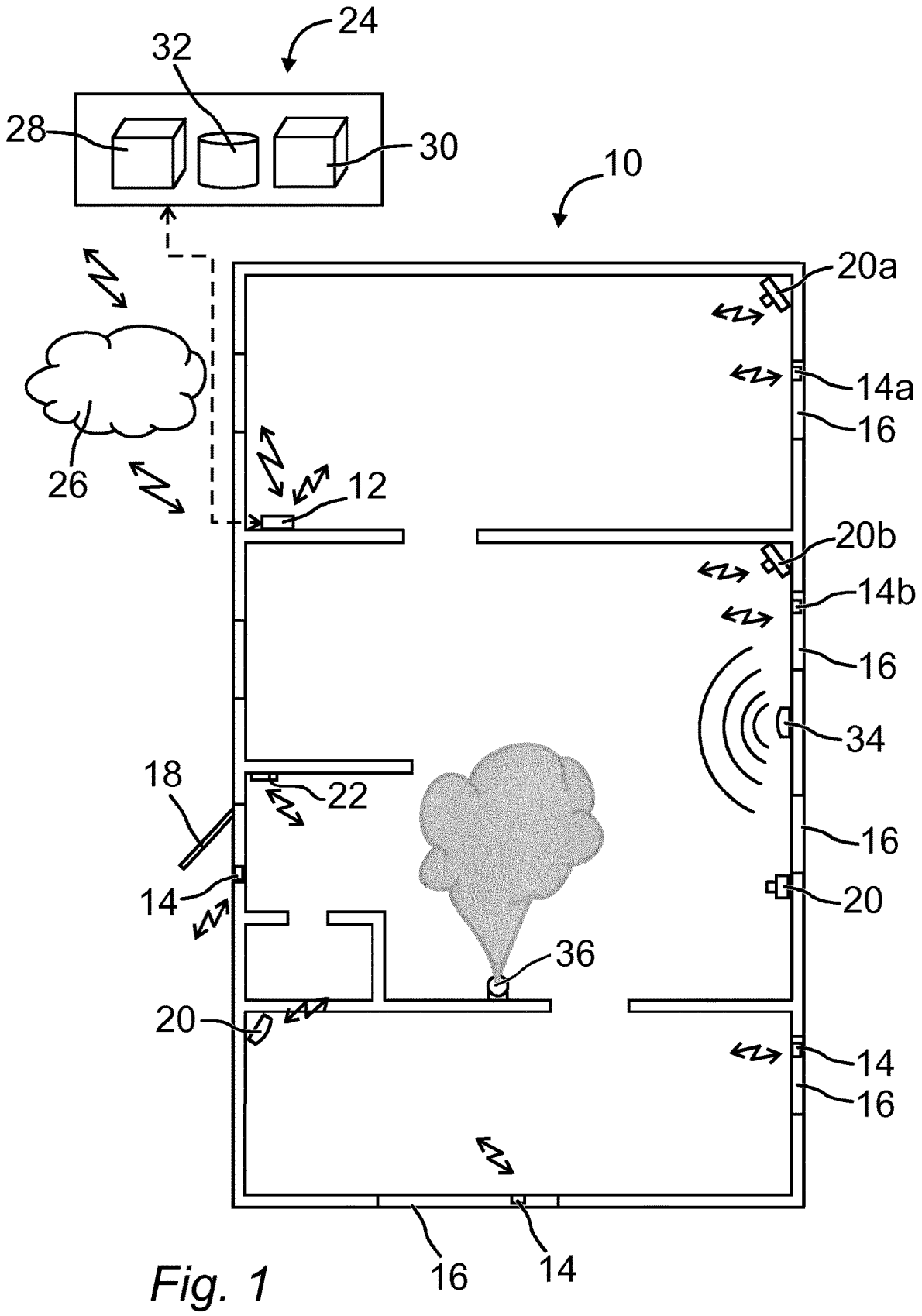
FIG. 1 is a schematic top view of one embodiment of an installation of an alarm system comprising a device in accordance with the invention.

In FIG. 1 an alarm system is arranged in premises in the form of a building 10. The alarm system comprises at least one control unit 12 also referred to as a gateway that, for example, includes a processor and an alarm unit for providing an alarm signal when the alarm is set off.

The alarm system comprises at least one and preferably a plurality of premises perimeter detectors 14, such as a first premises perimeter detector 14*a* and a second premises perimeter detector 14*b*. The premises perimeter detectors 14 are, for example, detectors sensitive to the presence or passage of persons and objects. For example, presence detectors include motion detectors, such as IR-detectors, and passage detectors include magnetic sensors arranged at windows 16 and doors, such as an entrance door 18. Other detectors with similar properties can also be included. The alarm system further comprises at least one and preferably a plurality of premises interior detectors 20, such as a first premises interior detector 20*a* and a second premises interior detector 20*b*. The interior detectors may include IR-sensors.

The control unit 12 is connected to the premises perimeter detectors 14, the premises interior detectors 20 and to input means 22, such as a key-pad or similar, for arming and disarming the detectors 14, 20 to arm and disarm the alarm system. For example, the control unit 12 is activated and controlled by the input means 22. Alternatively, the control unit 12 is provided with the input means 22. Alternatively, the input means 22 is a remote device, such as a wireless remote device. In the illustrated embodiment, the input means 22 is arranged in the vicinity of the entrance door 18. Alternatively, the input means 22 is arranged in any suitable location or is a portable device, such as a cell phone. The detectors 14, 20 are, for example, provided with wireless communication means for communicating with the control unit 12.

In the embodiment of FIG. 1 the control unit 12 is connected to an alarm receiving centre 24, such as a remote alarm receiving centre, either by wire, such as a telephone line as indicated in FIG. 1 with a dashed line, or by a wireless telecommunications system such as GSM or other radio frequency systems. The connection also can be through the internet 26. For example, the control unit 12 is provided with communication means for communicating with the remote alarm receiving centre 24. Alternatively, the alarm receiving centre 24 is located within the premises or within the building 10. In the embodiment shown in FIG. 1 the remote alarm receiving centre 24 comprises a web server 28, a control and communications unit 30 and a database 32. The web server 28 is an interface for a user to set up and to monitor the alarm system of the building 10. Different settings and information regarding the alarm system and different users of the alarm system are stored in the database 32. Communication between the user, the alarm system and the remote alarm receiving centre 24 is processed through the control and communications unit 30.

According to one embodiment at least one premises interior detector 20 comprises or is connected to an image capturing means, such as a camera, video camera or any other type of image capturing means, wherein the image capturing means is activated when said detector 20 is triggered. For example, at least one premises interior detector 20 comprises an image capturing means, which image capturing means is activated by the triggering of the interior detector 20 connected to it, so that the image capturing means is switched on when the interior detector 20 detects an unauthorized intrusion.

In the building 10 there is provided also a smoke generator 36 capable of producing and distributing an opaque smoke after being initiated and activated by the alarm system, preferably through the control unit 12. The smoke generator 36 can be arranged on a wall by a wall attachment or be designed to be placed on a table or shelf. After being activated the smoke generator 36 will emit smoke that eventually will fill the premises in the building.

Figure 2:
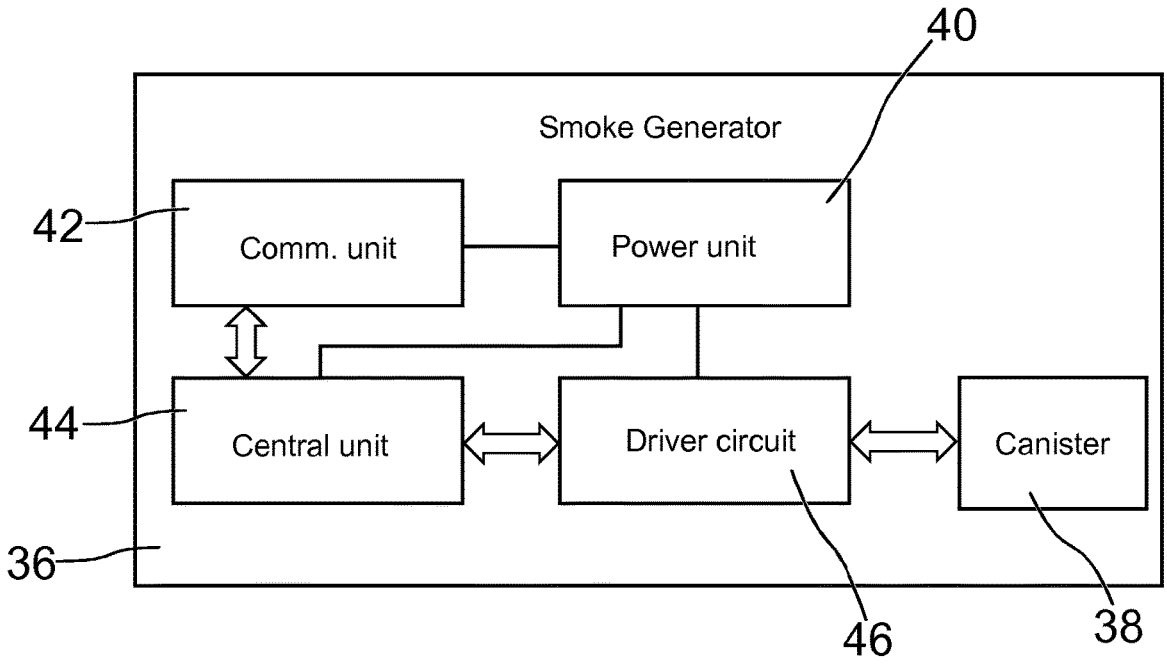
FIG. 2 is a schematic block diagram showing an embodiment of a device comprising a driver circuit in accordance with the invention.

The embodiment of the smoke generator 36 shown in FIG. 2 comprises a smoke generator component, referred to as a canister 38. The canister is a chemical pyrotechnic component which is available for instance from French company ALSETECH. The smoke generated is completely non-toxic and contains only very small amounts of CO and $CO_2$.

In various embodiments the smoke generator 36 is a stand-alone or self-contained unit where a battery or a set of batteries form a power supply unit 40. Communication between the smoke generator 36 and other peripheral units of the alarm system and specifically the control unit 12 is handled by a communication unit 42. The smoke generator 36 is controlled by a central unit 44, comprising a processor and memory units. The central unit 44 will communicate with the control unit 12 of the alarm system when an alarm situation occurs and activation of the smoke generator 36 is desired. Control signals from the central unit 44 are forwarded to a driver circuit 46 that is connected to the canister 38.

Figure 3:
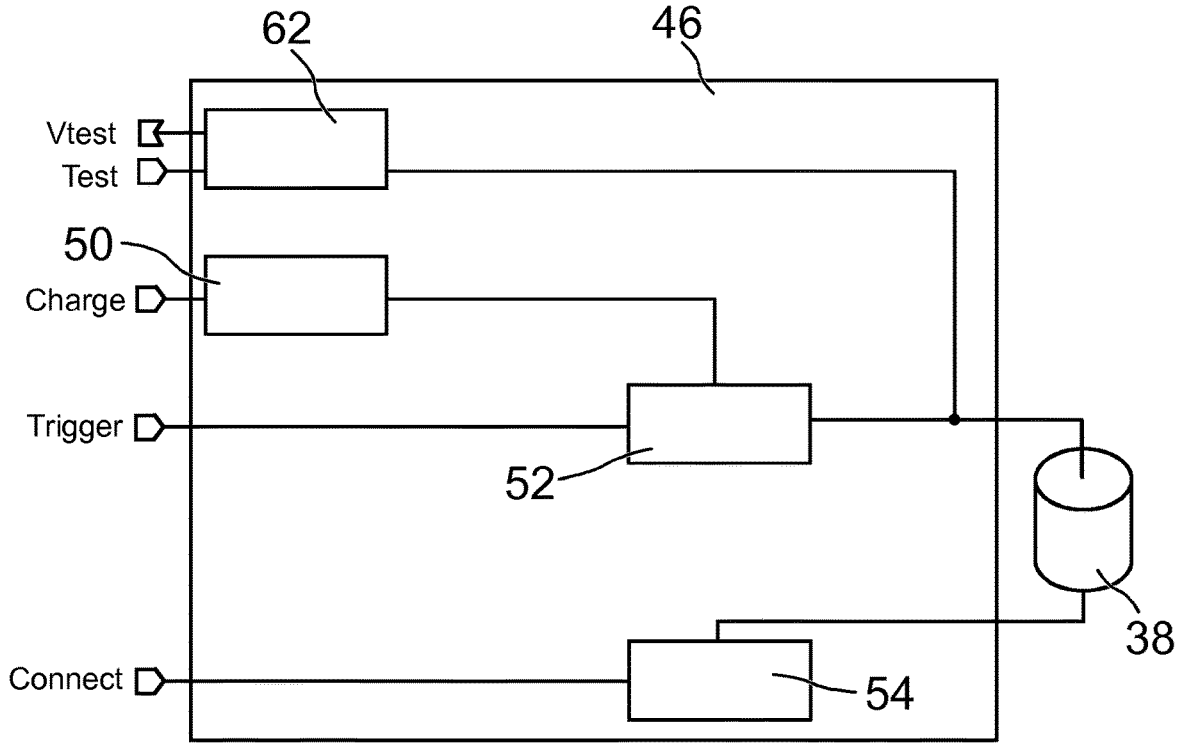
FIG. 3 is a schematic block diagram showing an embodiment of a driver circuit in accordance with the invention.
Figure 4:
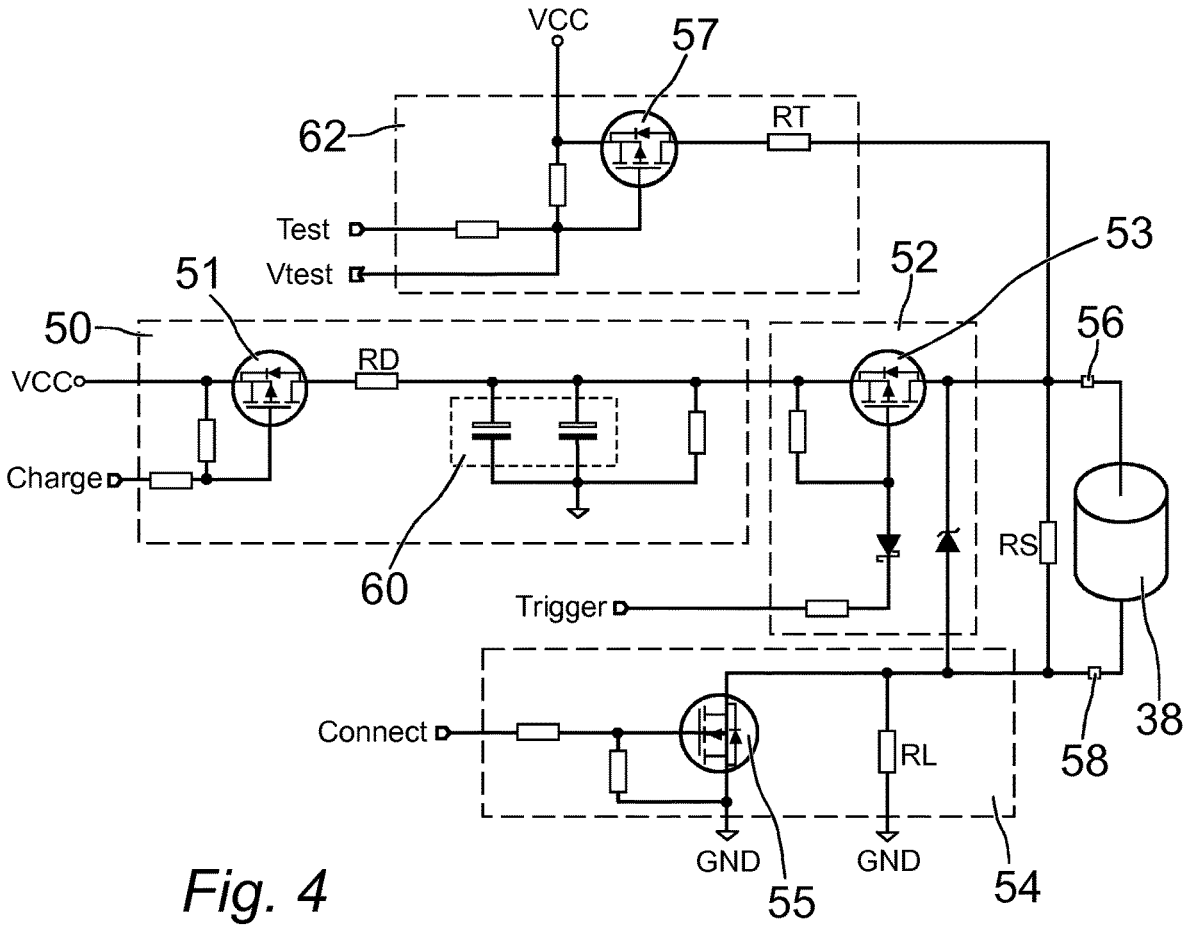
FIG. 4 is a schematic circuit diagram showing an embodiment of a driver circuit.

An embodiment of the driver circuit 46 of the smoke generator 36 as shown in FIG. 3 comprises a charging unit 50, a switching unit 52 and a connecting unit 54. The charging unit 50 comprises charging means, such as capacitors or similar components capable of storing electric energy, and electronic circuits for controlling supply of current from the power supply unit 40 to the charging means, c.f. FIG. 4. The charging unit 50 is connected to the central unit 44 and will receive a Charge signal when a smoke generator activating signal has been received by the central unit 44. The charging process of the charging means will take some time before an appropriate amount of energy has been obtained. In various embodiments a fixed time period is assigned for the charging process. In other embodiments the actual charged amount is measured by the central unit. No activation of the canister is possible during the charging process. A timing process for enabling and activating the smoke generator 36 is further explained below with reference to FIG. 5.

The canister 38 is connected to the connecting unit 54 which needs to enter a closing condition to allow the canister 38 to be activated properly. The closing condition is entered when a Connect signal is received from the driver circuit 46. The switching unit 52 is connected to the charging unit 50 and to the canister 38. In a final step for activating the canister 38 the switching unit 52 receives a trigger signal from the central unit 44. The switching unit 52 then switches on and energy stored in the charging unit 50 can be passed on to the canister 38 on the condition that the connecting unit 54 has entered the closing condition.

The driver circuit 46 further comprises a testing unit 62 which is connected to the canister 38. The testing unit 62 has an input Test and an output Vtest. By applying a signal at input Test it is possible to detect presence of the canister 38 and also to detect information relating to the physical status of the canister 38. These data can be used to detect tampering attempts and when exchange of the canister is due.

In the embodiment of a driver circuit 46 shown in FIG. 4 the charging unit 50 comprises a first active component 51. In the selected arrangement of power voltage, grounding of circuits and canister the first active component 51 is a P-channel enhancement mode MOSFET, such as one available from DIODES INCORPORATED as DMP2305U. In other arrangements, for instance with opposite polarities of power supply, other suitable components can be used still providing the same function. The charging unit 50 further comprises charging means 60. A suitable implementation of the charging means 60 is at least one, or as shown in FIG. 4 two, capacitors with a total capacity of 6.600 μF. The charging unit 50 comprises a restricting resistor RD that will limit charging current from power supply VCC to the charging means 60.

The switching unit 52 comprises in the shown embodiment a second active component 53. In the selected arrangement of power voltage, grounding of circuits and canister the second active component 53 is a P-channel trench MOSFET, such as one available from NXP SEMICONDUCTORS as PMV27UPE. In other arrangements, for instance with opposite polarities of power supply, other suitable components can be used still providing the same function. An activation signal at input Trigger will connect a first pole 56 of the canister 38 to the charging means 60. Restricting resistor RD will limit current also in a situation where an activation signal at input Trigger is given in error during a time period where also a signal is provided at Charge input.

The connecting unit 54 comprises in the shown embodiment a third active component 55. In the selected arrangement of power voltage, grounding of circuits and canister the third active component 55 is an N-channel trench MOSFET, such as one available from NXP SEMICONDUCTORS as PMV30UN2. In other arrangements, for instance with opposite polarities of power supply, other suitable components can be used still providing the same function. A pre-activation signal at input Connect will connect a second pole 58 of the canister 38 to ground (GND). A current limiting resistor RL, which is always connected between the second pole of the canister 38 and ground (GND) will limit the current through the canister below a level where the canister in is activated. In the shown embodiment RL is 3 k Ohm.

The testing unit 62 comprises a fourth active component 57. In the selected arrangement of power voltage, grounding of circuits and canister the fourth active component 57 is a P-channel enhancement mode MOSFET, such as one available from DIODES INCORPORATED as DMP2305U. In other arrangements, for instance with opposite polarities of power supply, other suitable components can be used still providing the same function. By applying a test signal at the Test input fourth active component 57 will enter an ON state and current will be allowed to flow through a limiting resistor RT to the canister 38. The limiting resistor RT, normally at about 3 k Ohm, will en-sure that the current to the canister 38 will be limited to a value below the value required for activation. In the shown embodiment, the current to the canister will be limited to a maximum value of 1 mA, even if the connecting unit 54 accidently is activated when the testing unit is activated. The current that actually flows through the canister when the test signal is applied will indicate presence of the canister 38 and also to some extent the status of content of the canister. A test output signal, Vtest, can be obtained at the fourth active component 57.

In a default mode all active components are in the OFF state. In this mode first pole 56 of canister 38 is connected to ground through shorting resistor RS and current limiting resistor RL. Second pole 58 of canister 38 is connected to ground through current limiting resistor RL. In the embodiment shown in FIG. 4 RS is 10 k Ohm. As a result, the smoke generator cannot be activated in this mode.

Normal steps for activating the smoke generator to provide smoke include provision of input signal at input Charge. This input signal and also other signals indicated in FIG. 3 and FIG. 4 are provided by central unit 44 on the basis of signals received from the control unit 12 indicating an alarm situation. Below the term HIGH implies supply voltage VCC or a voltage level close to that. Correspondingly, the term LOW implies ground GND or a voltage level close to that. An ON state of all active components corresponds to a closed switch condition, that is a condition where a maximum current flows through the component. An OFF state of all active components corresponds to an open switch condition, that is a condition where practically no current flows through the component. Signals at HIGH level are considered to be of opposite polarities as compared to signals at LOW level.

The type of semiconductor used as first active component 51 is put into an ON state by changing from HIGH to a LOW signal at the gate of the P-channel enhancement mode MOSFET. As a result, current will flow from power supply at VCC and start charging the charging means 60. The time required for charging the charging means 60 to an appropriate level may vary in dependence on selected components and voltage levels. In the embodiment shown in FIG. 4 a normal charging time is about 500 ms. Even when charged to an appropriate level no energy is automatically transferred to the canister 38 because the second active component 53 is maintained at an OFF state in which current is prevented from passing through. Also third active component 55 is kept at an OFF state to further prevent activation of canister 38.

First pole 56 of canister 38 is connected to "positive" units that will provide positive signals for activation of canister 38. These units are charging unit 50 and switching unit 52. Also the testing unit 62 is connected to first pole 56 of canister 38. Second pole 58 of canister 38 is connected to a "negative" unit that will provide a negative (or grounding) signal. Smoke generation requires that "positive" as well as "negative" units are activated during an overlapping time period. If "positive" charging unit 50 or "positive" switching unit 52 is activated while "negative" connecting unit 54 is not activated the maximum current that can flow through the canister 38 is limited by resistor RL. The limited current cannot activate smoke generation.

In a similar manner, if "negative" connecting unit 54 is activated while "positive" charging unit 50 and "positive" switching unit 52 are not activated no current can be supplied from power supply because first active component 51 and second active component 53 are both in the OFF state. As a result, no smoke generation can be activated. Furthermore, "positive" units and "negative" units in the shown embodiment are controlled with opposite polarities to reduce the probability of an accidental application of control signals in smoke generator 36.

Accidental activation of both control signals CHARGE and TRIGGER at the same time will not activate the smoke generation, as resistor RD will limit current to about 40 mA, which is a safe value. The designed charging time of about 500 ms will allow to incorporate easily safety mechanisms in the firmware to prevent undesired activation.

Figure 5:
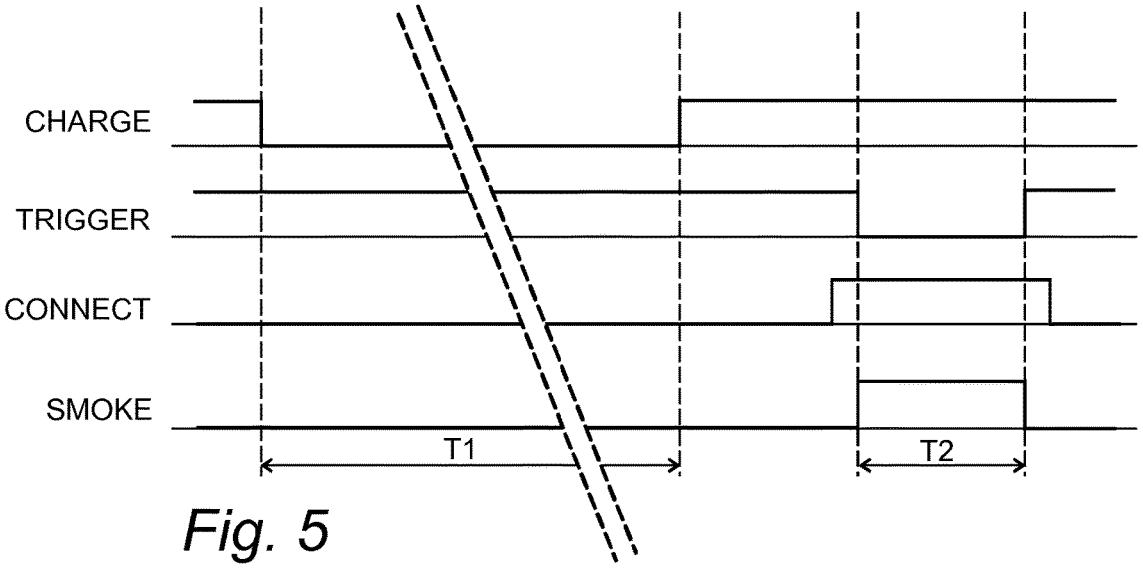
FIG. 5 is a timing diagram showing different steps for enabling and activation of the device in accordance with the invention.

Timing diagram of FIG. 5 shows how input signals CHARGE, TRIGGER and CONNECT interact to produce output FOG1 during normal conditions. The first step for activation of the smoke generator will be to activate input signal CHARGE by setting first active component 51 into ON state. This is done by applying a LOW signal. All other active components being in an OFF state current will flow through first active component 51 and through resistor RD to charging means 60. As set out above the time required for the charging means 60 to an appropriate level would be about 500 ms. Thus, time period T1 in FIG. 5 is equal to about 500 ms. After this time period input signal CHARGE is set to HIGH to set first active component 51 into OFF state. As a result, charging of charging means 60 is stopped.

In the shown embodiment, there is a short delay and then input signal CONNECT is activated by setting it to HIGH. In this state, third active component 55 will be set to ON resulting in a very low resistance. In practice this means that second pole 58 of canister 38 is connected to ground GND. This is a preparation for full activation of the canister which is done by activating input signal TRIGGER. Input signal CONNECT is maintained at HIGH during at least the full length of activated input signal TRIGGER.

Activation of input signal TRIGGER is done by setting it to LOW. As a result, second active component 53 is set to ON which in practice connects first pole 56 of canister 38 to charging means 60 and will allow a current at a high level to flow into the canister 38. Depending on the type of canister 38 the high level current can be about 1 A or more. As a result, smoke is generated during a time period T2. In the embodiment described above T2 is equal to or longer than 5 ms.

While certain illustrative embodiments of the invention have been described in particularity, it will be understood that various other modifications will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

The invention claimed is:

1. A driver circuit for controlling and powering a smoke generating canister to emit smoke, the driver circuit comprising:

a charging unit configured to provide, after a charging process of the charging unit, sufficient power to activate the smoke generating canister, a switching unit physically connected between the charging unit and a first pole of the smoke generating canister, wherein the switching unit, upon activation thereof, is configured to couple the power to activate the smoke generating canister from the charging unit to the smoke generating canister, and a connecting unit physically connected between a second pole of the smoke generating canister and electrical ground, wherein the connecting unit, upon activation thereof, is configured to couple the second pole to ground to complete an electrical circuit for the application of the power to activate the smoke generating canister to the smoke generating canister; and wherein only concurrent activation of both the switching unit and the connecting unit releases the power from the charging unit to the smoke generating canister so as to activate the smoke generating canister.

2. The driver circuit as claimed in claim 1, wherein the connecting unit and the switching unit are activated by signals of opposite polarities.

3. The driver circuit as claimed in claim 1, wherein the charging unit comprises a first active component, the switching unit comprises a second active component, and the connecting unit comprises a third active component, the first active component, the second active component, and the third active component having an ON state corresponding to a closed switch condition and an OFF state corresponding to an open switch condition.

4. The driver circuit as claimed in claim 3, wherein the connecting unit comprises a current limiting resistor connected between the second pole of the smoke generating canister and ground to limit current through the smoke generating canister when the third active component is in the OFF state.

5. The driver circuit as claimed in claim 3, wherein the charging unit comprises a restricting resistor connected between the first active component and one or more charge-storing elements, the restricting resistor limiting current flowing from the first active component.

6. The driver circuit as claimed in claim 1, further comprising a testing unit connected to the smoke generating canister and configured to provide a limited current that runs through the smoke generating canister and wherein an actual current flow from the testing unit is indicative of the smoke generating canister being connected or disconnected.

7. A method for controlling and powering a smoke generating canister to emit smoke, the smoke generating canister having a first electrical contact and a second electrical contact, and the smoke generating canister activated to emit the smoke by application of an activation power of sufficient amount across the first and second electrical contacts and with a current component of the activation power flowing through the smoke generating canister between the first and second electrical contacts, comprising:

applying a charging signal at a charging input of a driver circuit, the charging signal causing a charging unit of the driver circuit to store electrical energy therein, applying a control signal to a connect input of the driver circuit to switch a connecting unit of the driver circuit to an ON state in which the second electrical contact of the smoke generating canister is electrically connected to ground, and applying a trigger signal at a trigger input of the driver circuit to switch a switching unit of the driver circuit to an ON state in which the electrical energy from the charging unit is applied to the first electric contact of the smoke generating canister, the applied electrical energy being the activation power with the current component so activate the smoke generating canister during a time that the connecting unit and the switching unit are each in their respective ON states.

8. A smoke generator, comprising:

a communication unit, a central unit, a driver circuit, a power unit, and a smoke generating canister, wherein the communication unit is arranged to receive a signal for activating the smoke generating canister to emit smoke from a signal source, and the central unit, in response to receipt of the signal for activating the smoke generating canister, produces a plurality of control signals for activating and controlling said driver circuit, and the power unit supplies power for the smoke generator, and wherein the smoke generator is a self-contained unit, wherein said driver circuit comprises:

a charging unit configured to provide, after a charging process of the charging unit, sufficient power to activate the smoke generating canister, a switching unit physically connected between the charging unit and a first pole of the smoke generating canister, wherein the switching unit, upon activation thereof, is configured to couple the power to activate the smoke generating canister from the charging unit to the smoke generating canister, and a connecting unit physically connected between a second pole of the smoke generating canister and electrical ground, wherein the connecting unit, upon activation thereof, is configured to couple the second pole to ground to complete an electrical circuit for the application of the power to activate the smoke generating canister to the smoke generating canister; and wherein only concurrent activation of both the switching unit and the connecting unit releases the power from the charging unit to the smoke generating canister so as to activate the smoke generating canister.

9. A driver circuit for controlling and powering a smoke generating canister, the driver circuit comprising a power output connected to the smoke generating canister for activation thereof, a charging unit providing after a charging process sufficient power for igniting and driving the smoke generating canister, a switching unit connected to the charging unit and to a first pole of the smoke generating canister for releasing power from the charging unit to the smoke generating canister, and a connecting unit connected to a second pole of the smoke generating canister for allowing power to flow through the smoke generating canister, wherein activation of both the connecting unit and the switching unit during an overlapping time period is required for activation of the smoke generating canister; and wherein the charging unit comprises a first active component, the switching unit comprises a second active component, and the connecting unit comprises a third active component, the first active component, the second active component, and the third active component having an ON state corresponding to a closed switch condition and an OFF state corresponding to an open switch condition.

10. The driver circuit as claimed in claim 9, wherein the connecting unit comprises a current limiting resistor connected between the second pole of the smoke generating canister and ground to limit current through the smoke generating canister when the third active component is in the OFF state.

11. The driver circuit as claimed in claim 9, wherein the charging unit comprises a restricting resistor connected between the first active component and one or more charge-storing elements, the restricting resistor limiting current flowing from the first active component.

* * * * *